US009149851B2

(12) United States Patent
Hiraoka et al.

(10) Patent No.: US 9,149,851 B2
(45) Date of Patent: Oct. 6, 2015

(54) METALLIC MOLDED SHEET AND HEAT SHIELDING COVER

(75) Inventors: Akinao Hiraoka, Tokyo (JP); Motonori Kondoh, Tokyo (JP); Tadakatsu Kato, Tokyo (JP); Takahiro Niwa, Tokyo (JP)

(73) Assignee: NICHIAS CORPORATION, Tokyo (JP)

( * ) Notice: Subject to any disclaimer, the term of this patent is extended or adjusted under 35 U.S.C. 154(b) by 0 days.

(21) Appl. No.: 13/439,985

(22) Filed: Apr. 5, 2012

(65) Prior Publication Data

US 2012/0192610 A1 Aug. 2, 2012

Related U.S. Application Data

(62) Division of application No. 12/366,153, filed on Feb. 5, 2009, now abandoned.

(30) Foreign Application Priority Data

Feb. 8, 2008 (JP) ..... P.2008-029003

(51) Int. Cl.
*B21D 13/04* (2006.01)
*B21B 1/22* (2006.01)

(52) U.S. Cl.
CPC ..... *B21D 13/04* (2013.01); *B21B 1/227* (2013.01); *Y10T 428/12417* (2015.01)

(58) Field of Classification Search
CPC ..... B21D 13/04; B21D 13/045; B21B 1/227; B21B 13/08; B21B 27/005
USPC ..... 72/187, 195, 196, 197, 198, 234, 379.6, 72/226, 231
See application file for complete search history.

(56) References Cited

U.S. PATENT DOCUMENTS

| | | | | |
|---|---|---|---|---|
| 107,752 | A | 9/1870 | Barker | |
| 662,567 | A | 11/1900 | Lipowska | |
| 1,150,805 | A * | 8/1915 | Beran | 72/478 |
| 1,185,881 | A * | 6/1916 | Cooper | 125/24 |
| 2,252,209 | A * | 8/1941 | Schank et al. | 72/379.6 |

(Continued)

FOREIGN PATENT DOCUMENTS

| | | |
|---|---|---|
| DE | 124 012 | 2/1976 |
| GB | 1 326 519 | 8/1973 |

(Continued)

OTHER PUBLICATIONS

Great Britain Examination Report dated Oct. 10, 2011 issued in Great Britain Patent Application No. 0902035.5, 2 pp.

(Continued)

*Primary Examiner* — Edward Tolan
(74) *Attorney, Agent, or Firm* — Nixon & Vanderhye P.C.

(57) ABSTRACT

The present invention relates to a metallic molded sheet including a metallic sheet having first ridges continuously formed along a first direction and second ridges continuously formed along a second direction which is perpendicular to the first direction, in which the metallic molded sheet has cross-sectional shapes along the first direction and the second direction, each having an identical thickness and continuing sinusoidally, and the metallic molded sheet has a planar shape being a corrugated surface in which ridge lines of first waveforms along the first direction and ridge lines of second waveforms along the second direction perpendicularly intersect each other.

5 Claims, 7 Drawing Sheets

(56) References Cited

U.S. PATENT DOCUMENTS

| | | | | | |
|---|---|---|---|---|---|
| 2,290,608 | A | * | 7/1942 | Evans | 72/196 |
| 2,441,476 | A | * | 5/1948 | Ewald | 428/604 |
| 2,481,046 | A | | 9/1949 | Scurlock | |
| 3,034,212 | A | | 5/1962 | Reifers | |
| 3,956,915 | A | * | 5/1976 | Saunders | 72/198 |
| 3,992,835 | A | | 11/1976 | Saveker | |
| 4,044,186 | A | | 8/1977 | Stangeland | |
| 4,092,842 | A | * | 6/1978 | Oser et al. | 72/379.6 |
| 4,343,866 | A | | 8/1982 | Oser et al. | |
| 4,986,105 | A | * | 1/1991 | Hoglund | 72/180 |
| 5,207,083 | A | * | 5/1993 | Bongiovanni et al. | 72/8.3 |
| 5,670,264 | A | | 9/1997 | Sheridan | |
| 5,679,479 | A | * | 10/1997 | Young et al. | 429/147 |
| 5,800,905 | A | | 9/1998 | Sheridan et al. | |
| 6,139,974 | A | | 10/2000 | Atkinson et al. | |
| 6,183,879 | B1 | | 2/2001 | Deeley | |
| 6,197,129 | B1 | * | 3/2001 | Zhu et al. | 148/400 |
| 6,280,856 | B1 | | 8/2001 | Andersen et al. | |
| 6,497,130 | B2 | * | 12/2002 | Nilsson | 72/252.5 |
| 7,516,637 | B2 | * | 4/2009 | Scamans et al. | 72/187 |
| 7,785,696 | B2 | * | 8/2010 | Boatman et al. | 428/156 |
| 7,947,380 | B2 | | 5/2011 | Deeley et al. | |
| 7,958,763 | B2 | * | 6/2011 | Ligda | 72/181 |
| 8,291,742 | B2 | * | 10/2012 | Haesemann et al. | 72/379.6 |
| 2007/0029073 | A1 | * | 2/2007 | Teshima et al. | 165/109.1 |

FOREIGN PATENT DOCUMENTS

| | | | | |
|---|---|---|---|---|
| GB | 2 279 596 | | 1/1995 | |
| GB | 2 287 988 | | 10/1995 | |
| GB | 2 316 028 | | 2/1998 | |
| JP | 51-42069 | | 11/1976 | |
| JP | 2-92401 | * | 4/1990 | B21B 1/22 |
| JP | 3-77730 | | 4/1991 | |
| JP | 7-60371 | | 3/1995 | |
| JP | 2000-136720 | | 5/2000 | |
| JP | 2001-504393 | | 4/2001 | |
| JP | 2001-507282 | | 6/2001 | |
| JP | 3233364 | | 9/2001 | |
| JP | 2001-347323 | | 12/2001 | |
| JP | 3337222 | | 8/2002 | |
| WO | WO 96/41691 | | 12/1996 | |
| WO | WO 98/06517 | | 2/1998 | |
| WO | WO 98/06567 | | 2/1998 | |

OTHER PUBLICATIONS

Japanese Office Action dated Apr. 17, 2012 issued in Japanese Patent Application No. 2008-029003, 4 pp.

Merriam-Webster, definition of the term "sinusoidal," Dec. 1, 2011, one page.

Office Action dated Jul. 26, 2011 issued in United Kingdom Patent Application No. 0902035.5, 3 pp.

Notification and English translation in JP 2008-029003 dated Apr. 5, 2010.

Notification and English translation in JP 2008-029003 dated Dec. 3, 2010.

Office Action mailed Dec. 25, 2012 in Japanese Patent Application No. 2008-029003 and English Translation, 4 pp.

Notification (third party's submission) mailed on Aug. 28, 2012 in connection with Japanese Patent Application No. 2008-29003 and English translation, 16 pp.

Notification (third party's submission) mailed on Sep. 4, 2012 in connection with Japanese Patent Application No. 2008-29003 and English translation, 3 pp.

Japanese Office Action mailed Aug. 13, 2013 in Japanese Patent Application No. 2008-029003 and English Translation, 4 pp.

Third Party's Submission mailed May 20, 2013 in Japanese Patent Application No. 2008-29003 and English translation, 18 pp.

* cited by examiner

METALLIC MOLDED SHEET AND HEAT SHIELDING COVER

CROSS-REFERENCES TO RELATED APPLICATIONS

This application is a divisional of U.S. patent application Ser. No. 12/366,153, filed Feb. 5, 2009 now abandoned, which claims the benefit of Japanese Patent Application No. 2008-029003, filed Feb. 8, 2008, the entire contents of each of which are hereby incorporated by reference in this application.

FIELD OF THE INVENTION

The present invention relates to a metallic molded sheet which has corrugated irregularities formed therein and is suitable as a shielding cover which is disposed on a heat generating portion of such as a household electrical appliance, or an exhaust pipe, an engine, or the like of an automobile.

BACKGROUND OF THE INVENTION

Since an automobile during engine operation produces exhaust gases at high temperatures of 900° C. or more, exhaust system parts, such as an exhaust manifold, a catalyst system, pipes, a muffler, and the like undergo high temperatures. Therefore, a large number of heat shielding covers are provided in their peripheries for the purposes of prevention of thermal damage and prevention of burn injury. Further, since these heat shielding covers are in many cases provided in narrow and extensive ranges in the vicinities of the high-temperature exhaust system parts, they often tend to be such complex and large-sized covers as to conform to the shape of matching members. In addition, control of $CO_2$, which has its inception in the issue of global warming in recent years, is an important challenge, and, for automobiles, individual parts are required to be more lightweight. In particular, in the case of the heat shielding covers around automobile exhaust systems whose temperatures tend to be high, as described above, the number of places where they are used is ever increasing, and the light weight has been an extremely important task.

Conventionally, deep-drawn products of steel sheets (galvanized steel sheets, aluminized steel sheets, or the like are actually used due to problems in rust prevention) have been frequently used as these heat shielding covers. Since the steel sheets exhibit elongation required for deep drawing and have sufficient strength and rigidity, the steel sheets have satisfied shape retainability and durability against stone bounding and the like which are required as the heat shielding covers. However, large-sized heat shielding covers weigh as much as several tens of kilograms, and fixing portions for supporting them are also required to have strength and durability, so that tendencies toward greater size and heavier weight are naturally underway, which is contrary to the tendency toward lighter weight. In addition, even in sheets which excel in elongation such as steel sheets, low-length portions are partially present in deep drawing which is accompanied by reduced sheet thickness, and stress-concentrated portions where fracture can occur during deep drawing forming or which can be a cause of fracture are inherent. Hence, there are frequent defects in which these stress-concentrated portions lead to breakage in high-load environments (high temperature, high vibration, salt damage environment, long-time assurance, etc.) as in automobiles. The prevention of starters of these fractures is also an important task in providing a highly reliable heat shielding cover.

In order to overcome these problems, a number of inventions have already been made and put to practical use. For example, a heat shielding cover is known in which semi-spherical protrusions (embosses) having complex shapes and different diameters are imparted to a steel sheet or an aluminum sheet by drawing (refer to patent document 1). According to this publication, it is possible to provide high rigidity for a sheet of equal thickness by the portion of the protrusion, and since the shape retainability increases, the function of the heat shielding cover can be demonstrated, and light weight can also be realized. However, since the imparting of the protrusions is dependent upon drawing, the molding of the cover shape is dependent upon the material characteristics which the original sheet has. As long as a steel sheet having an elongation rate of several tens of percent is used, the case would be different, but in the case of an aluminum sheet several percent to ten-odd percent is a limit of its elongation rate, and it is difficult to say that sufficient deep drawability can be ensured. Furthermore, as for the protruding portions, the sheet thickness becomes thinner than the planar portions, so that the strength is low, and there are cases where cracks, pinholes, or the like are produced during the shape forming.

In addition, a sheet is also known in which ridges having inwardly curved side walls are regularly arranged in a two-dimensional plane by bending (refer to patent document 2). According to this publication, the shape retainability as a cover is improved by the rigidity which the ridges possess. In addition, as the material stored in the ridges having reentrant side walls returns to its original shape owing to the molding force during the molding of the cover, moldability similar to that of deep drawing is consequently demonstrated, and the percentage of the material stored in the ridges becomes equivalent to the elongation rate in principle. For this reason, moldability into a lightweight and complex shape is provided without producing a reduction in the sheet thickness within that range, and it becomes possible to ensure durability in a high-load environment. However, if the sheet is compressed in its thickness direction during the press molding of the cover, the material stored in the ridge portions is released and at the same time undergoes shrinkage in ridges in their vicinities, but an inverse folding force is loaded to the reentrant portions in the ridges. Since a metal sheet is ordinarily work hardened during machining such as side wall forming by strike bending, and the aluminum sheet or the like, in particular, has a small elongation rate, there is a possibility that the bent portion becomes fractured due to the inverse bending force loaded on the reentrant side wall, and it is apprehended that this fractured portion may become a flaw in a vibrational environment, and a very small fracture may progress and lead to the breakage of the cover. In addition, there are cases where a crack occurs along the ridge during molding.

Patent Document 1 JP-A-2000-136720

Patent Document 2 JP-T-2001-507282

SUMMARY OF THE INVENTION

Accordingly, an object of the invention is to provide a metallic molded sheet which is suitable as a heat shielding cover and which has moldability into a complex shape, has light weight and sufficient shape retainability, has high reliability against fracture and the like in a high-load environment, and is free of cracks and breakage during molding.

FIG. 6 is a top view schematically illustrating a heat insulating sheet described in the patent document 2, and FIGS. 7A and 7B are an X-X cross-sectional view and a Y-Y cross-sectional view of FIG. 6, respectively. A heat shielding cover 10 described in the patent document 2 is fabricated such that after first waveforms 20*a* are formed by passing a flat aluminum sheet between a pair of first corrugating rolls, the flat aluminum sheet with the first waveforms 20*a* formed thereon is passed between a pair of second corrugating rolls disposed with their teeth faces arranged perpendicularly to those of the first corrugating rolls to thereby allow second waveforms 20*b* to cross over the first waveforms 20*a* perpendicularly thereto. The present inventors confirmed that bent portions 22 are produced if the first corrugating rolls and the second corrugating rolls having the same teeth profile and roll gap (gap between the pair of rolls) are used.

Accordingly, when a flat aluminum sheet was similarly worked by using the first corrugating rolls and the second corrugating rolls having different roll gaps, the present inventors found that the bent portions are not produced.

Namely, the present invention relates to the following item (1) to (5).

(1) A metallic molded sheet including:

a metallic sheet having first ridges continuously formed along a first direction and second ridges continuously formed along a second direction which is perpendicular to the first direction, in which the metallic molded sheet has cross-sectional shapes along the first direction and the second direction, each having an identical thickness and continuing sinusoidally, and the metallic molded sheet has a planar shape being a corrugated surface in which ridge lines of first waveforms along the first direction and ridge lines of second waveforms along the second direction perpendicularly intersect each other.

(2) A heat shielding cover which is disposed to a heat generating portion, including the metallic molded sheet according to (1) which is three-dimensionally molded in conformity with a shape of the heat generating portion.

(3) The heat shielding cover according to (2), in which the heat shielding cover is for an engine exhaust system part or an exhaust pipe.

(4) A process for producing a metallic molded sheet, the process including:

passing a metallic sheet between a pair of first corrugating rolls having on their respective surfaces teeth with sinusoidal waveforms in their cross sections, to thereby obtain a metallic molded sheet having first waveforms, and passing the metallic molded sheet having the first waveforms between a pair of second corrugating rolls having on their respective surfaces teeth with sinusoidal waveforms in their cross sections, so that ridge lines of the first waveforms and ridge lines of teeth of the second corrugating rolls perpendicularly intersect each other.

(5) The process for producing a metallic molded sheet according to (4), in which a roll gap between the second corrugating rolls is 0.3 to 3-fold a roll gap between the first corrugating rolls.

According to the invention, it is possible to obtain a metallic molded sheet having a corrugated surface in which two kinds of waveforms each having a sinusoidal cross section perpendicularly intersect each other without forming bent portions at the portions where the two kinds of waveforms perpendicularly intersect each other. In addition, it is possible to maintain the thickness of the starting metal sheet as it is over the entire surface, and the metallic molded sheet has high strength, has no unevenness in strength, and is free of the occurrence of cracks or pinholes during molding. For this reason, even if this metallic molded sheet is disposed by being molded into an arbitrary shape as a heat shielding cover, cracks do not occur at the portions where the two kinds of waveforms perpendicularly intersect each other, and the durability thereof becomes excellent. In addition, since reentrant side walls are absent, fracture at the time of unbending is difficult to occur, so that the durability is high in a vibratory environment. Furthermore, since ridges are formed by bending, it is possible to obtain performance equivalent to that of deep drawability based on unbending.

DESCRIPTION OF REFERENCE NUMERALS AND SIGNS

1 metallic molded sheet
2*a* first waveform
2*b* second waveform
100 metal sheet
200*a* and 200*b* first corrugating rolls
210*a* and 210*b* second corrugating rolls
D roll gap

DETAILED DESCRIPTION OF THE INVENTION

Hereafter, the invention will be described in detail below with reference to the drawings.

Figure 1:
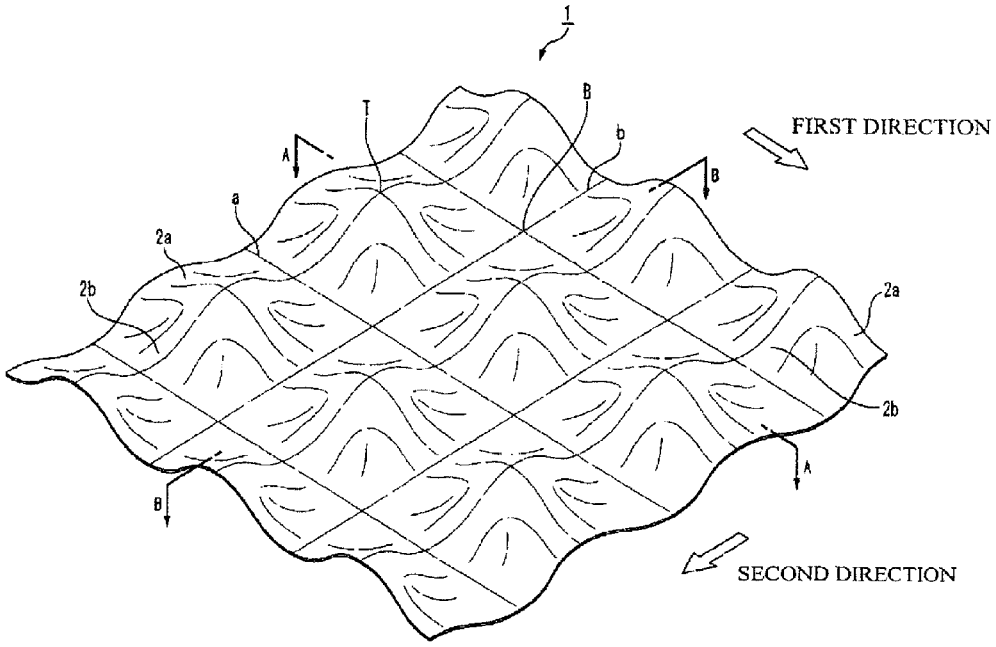
FIG. 1 is a perspective view schematically illustrating a portion of an aluminum sheet in accordance with the invention.

FIG. 1 is a perspective view schematically illustrating a metallic molded sheet in accordance with the invention, and its portion is shown in enlarged form. As illustrated in the drawing, a metallic molded sheet 1 has a corrugated surface in which ridge lines of first waveforms 2*a* extending along a first direction and ridge lines of second waveforms 2*b* extending along a second direction perpendicular to the first direction cross over each other. Namely, a portion where a crest of the first waveform 2*a* and a crest of the second waveform 2*b* cross over each other forms a highest point T of the corrugated surface, and this highest point T is disposed at a lattice point, such that the surface gradually declines from each highest point T in all directions to form an inclined surface. In addition, a lowest point B of the corrugated surface is a portion where a trough of the first waveform 2*a* and a trough of the second waveform 2*b* cross over each other. In other words, the lowest point B of the corrugated surface is located immediately below a point of intersection of diagonals connecting the adjacent four highest points T. Incidentally, straight lines a and b, ridge lines of the respective waveforms 2*a* and 2*b*, and lines depicted on inclined surfaces are for the sake of description and are not actually seen. However, there are cases where they partially remain as traces of working.

Figure 2A:
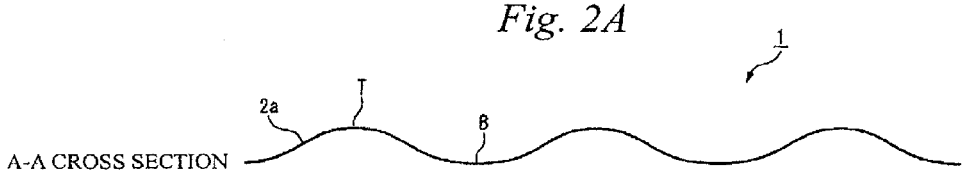
FIGS. 2A and 2B are an A-A cross-sectional view and a B-B cross-sectional view of FIG. 1, respectively.
Figure 2B:
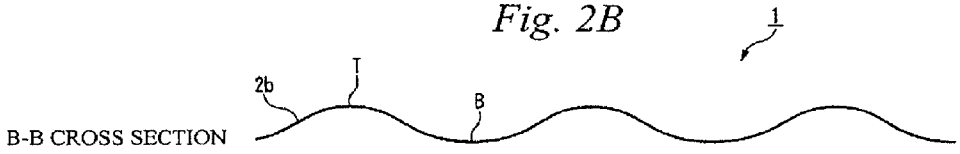
Figure 7A:
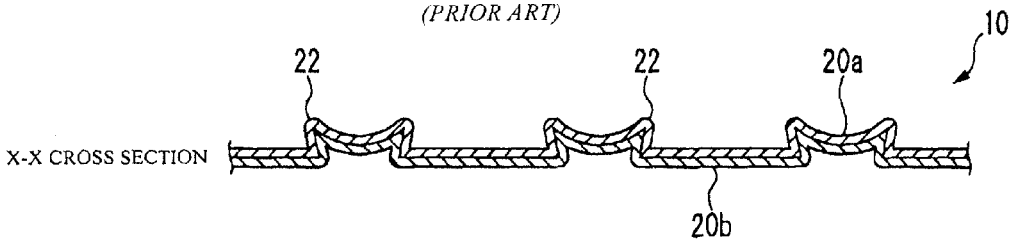
Fig. 7A (PRIOR ART)
FIGS. 7A and 7B are an X-X cross-sectional view and a Y-Y cross-sectional view of FIG. 6, respectively.
Figure 7B:
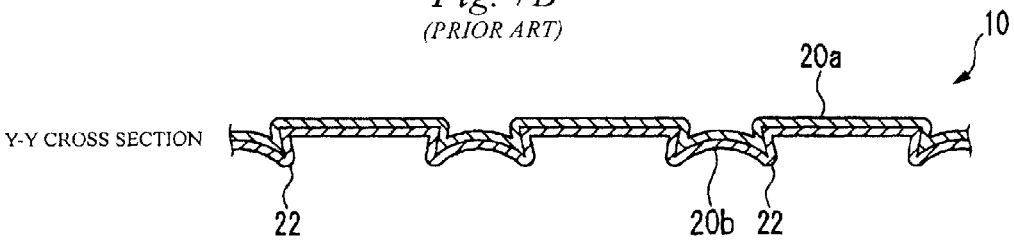
Fig. 7B (PRIOR ART)

In addition, FIGS. 2A and 2B show a cross-sectional view (A-A cross-sectional view of FIG. 1) taken along the ridge line of the first waveform 2*a* and a cross-sectional view (B-B cross-sectional view of FIG. 1) taken along the ridge line of the second waveform 2*b*, respectively. Both cross-sectional views show substantially identical waveforms, and such bent portions as those shown in FIGS. 7A and 7B are not present.

Figure 3:
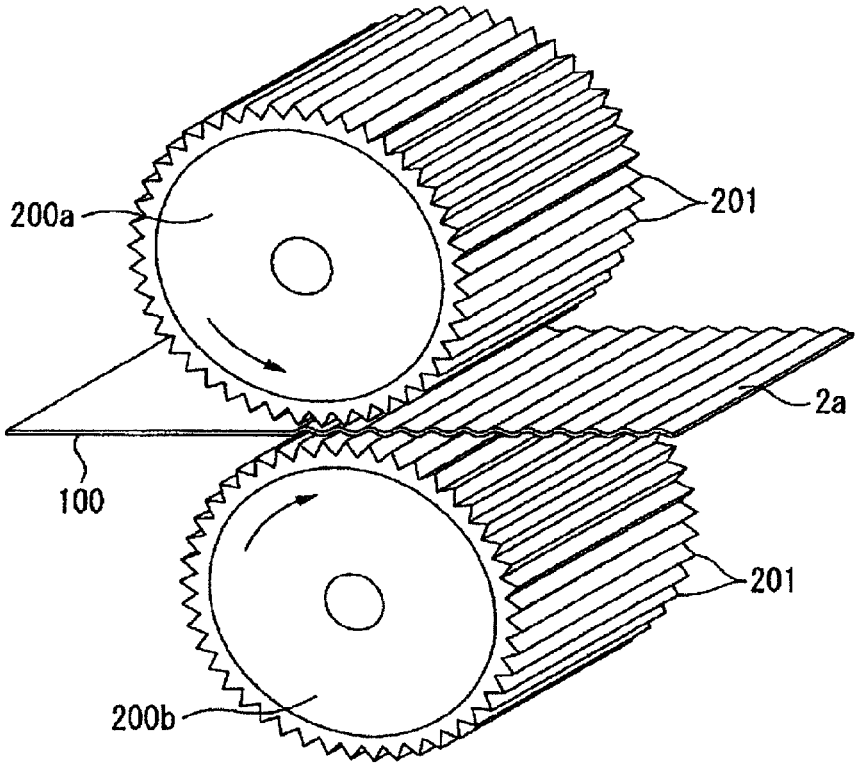
FIG. 3 is a schematic view illustrating a process of forming first waveforms.

In order to prepare such a metallic molded sheet 1, two corrugating rolls are used. First, as shown in FIG. 3, a flat metal sheet 100 is passed between a pair of first corrugating rolls (gear rolls) 200*a* and 200*b* having on their respective surfaces teeth 201 with a sinusoidal waveform in terms of their cross section. In consequence, the first waveforms 2*a* each having a sinusoidal waveform in terms of the cross section are formed in the metal sheet 100. The advancing direction of the metal sheet 100 at this time is the first direction in FIG. 1. In addition, the wave height of the first corrugating rolls 200*a* and 200*b* is appropriately selected according to the application of the metallic molded sheet 1, and if a heat shielding sheet is taken as an example, the wave height of the first corrugating rolls 200*a* and 200*b* is preferably 0.2 to 3 mm in the light of the strength and moldability, and the interval between crests (pitch) is preferably set to 3 to 9 mm.

Figure 4:
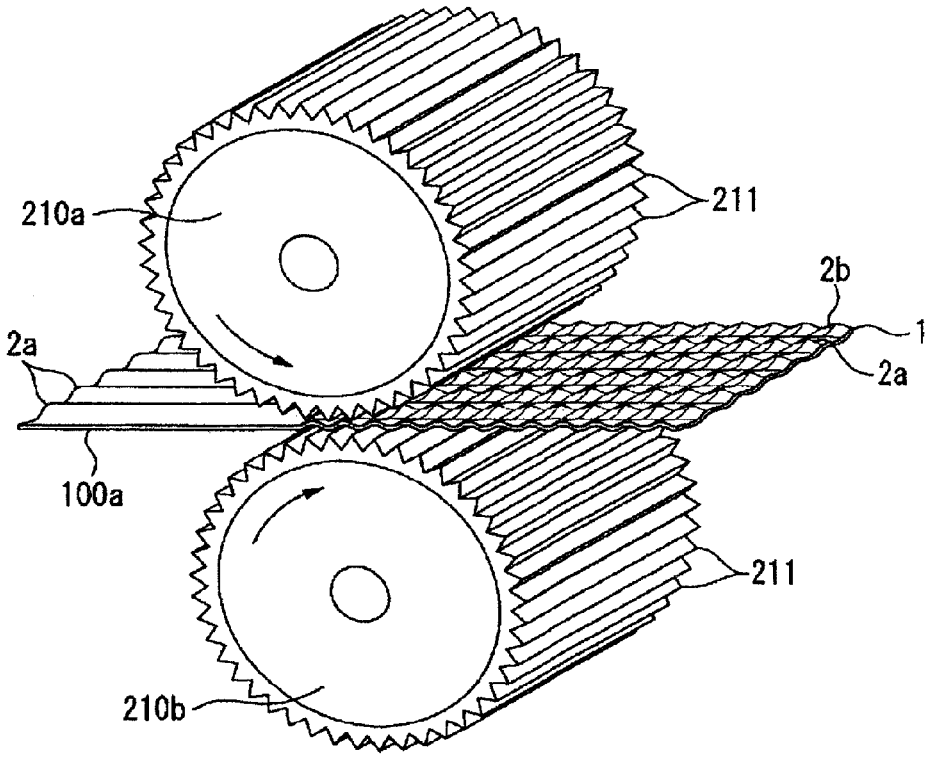
FIG. 4 is a schematic view illustrating a process of forming second waveforms.
Figure 5:
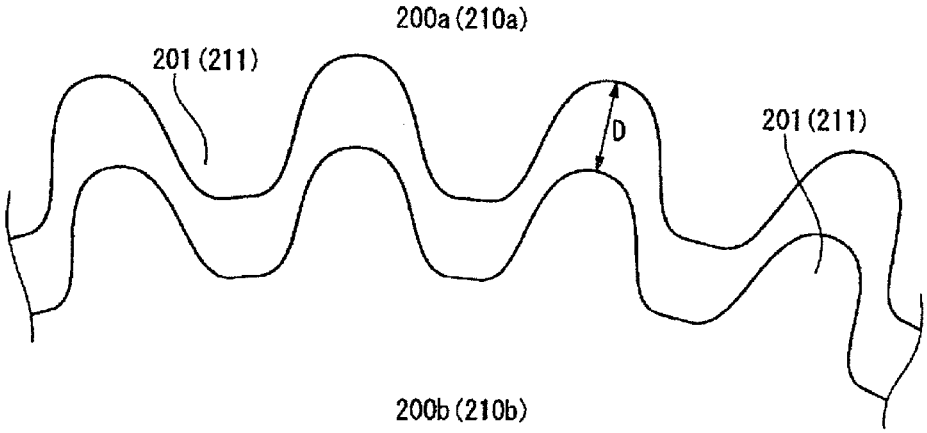
FIG. 5 is an enlarged view of teeth and their vicinities of the first corrugating rolls or the second corrugating rolls.
Figure 6:
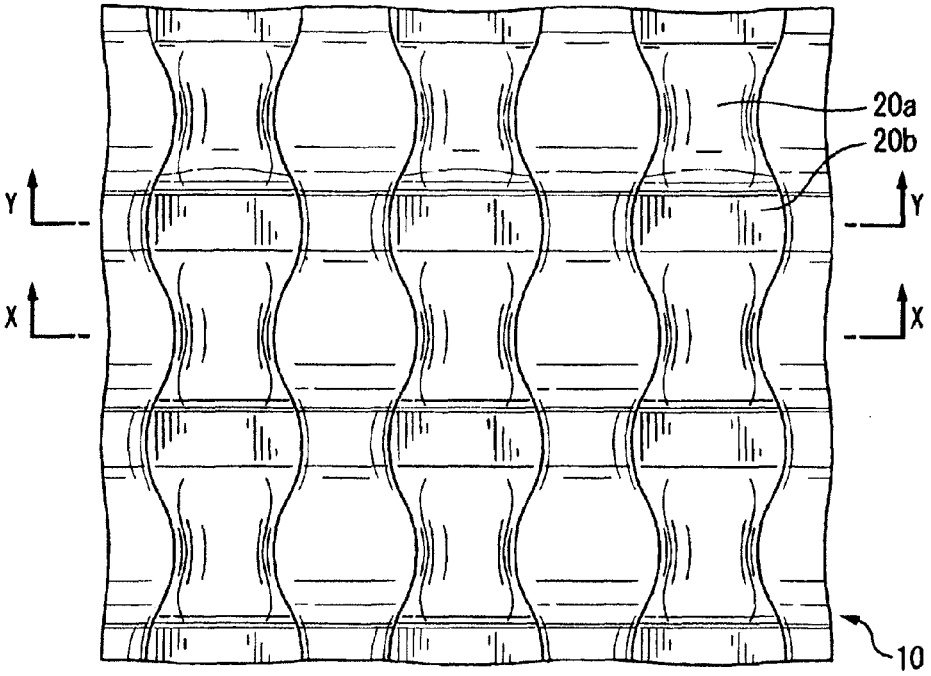
Fig. 6 (PRIOR ART)
FIG. 6 is a top view schematically illustrating a conventional heat insulating sheet.

Next, as shown in FIG. 4, a metallic molded sheet 100*a* with the first waveforms 2*a* formed therein is passed between a pair of second corrugating rolls (gear rolls) 210*a* and 210*b* having the same teeth profile as, and a different roll gap (D) from, the first corrugating rolls 200*a* and 200*b*, as shown in enlarged form in FIG. 5, in such a way that the ridge lines of the first waveforms 2*a* and ridge lines of teeth 211 of the second corrugating rolls 210*a* and 210*b* perpendicularly intersect each other. Incidentally, the advancing direction of the metal sheet 100*a* at this time is the second direction in FIG. 1. Thus, the second waveforms 2*b* each having a sinusoidal waveform in their cross section and perpendicularly intersecting the first waveforms 2*a* are formed by the second corrugating rolls 210*a* and 210*b*, thereby making it possible to obtain the metallic molded sheet 1 shown in FIG. 1.

As described above, in the present invention, corrugation is performed by using a pair of gear rolls whose cross-sectionally corrugated recessed portions and protruding portions are meshed with each other in the form of gears. In a method in which an emboss pattern is continuously transferred by using, instead of gear rolls, a pair of rollers which have grooves in respective roller shafts and mesh with each other, the metal sheet at the pattern portion is drawn, and since the sheet thickness becomes thin at that portion, cracks and pinholes are likely to occur.

In the above description, since the crossover between the first waveforms 2*a* and the second waveforms 2*b* is effected smoothly, and the deformation of the waveform is less, the roll gap between the second corrugating rolls 210*a* and 210*b* is preferably set to be 0.3 to 3-fold the roll gap between the first corrugating rolls 200*a* and 200*b*.

In addition, although the thickness of the metal sheet 100 is appropriately selected according to the application of the metallic molded sheet 1, a thickness of 0.2 to 0.5 mm is generally adopted in the case where the metallic molded sheet 1 is used as a heat shielding cover. In the invention, a steel sheet, an aluminum sheet, a stainless steel sheet, or the like is used as the metal sheet. Incidentally, the aluminum sheet includes an aluminum alloy sheet in addition to a pure aluminum sheet. For example, as shielding materials for the automobile, 3000 series aluminum alloy sheets based on AA or JIS Standards are frequently used in the light of the recycling characteristics and cost, and it is possible to use this 3000 series aluminum alloy sheet.

A 3004 aluminum alloy is known as a typical 3000 series aluminum alloy. This 3004 aluminum alloy is used for application to can containers and the like, and the amount of its production in Japan reaches as high as 300,000 tons per year. For this reason, the advantage in cost due to mass production is large, and the 3004 aluminum alloy is much more inexpensive than, for instance, a 5000 series aluminum alloy. As for the 3004 aluminum alloy, although strength thereof is generally lower than the 5000 series alloy, the amount of Mg added is about 1%, and rollability thereof is excellent. Therefore, the 3004 aluminum alloy is costwise advantageous in terms of production of sheets. In addition, the 3004 aluminum alloy has mechanical characteristics in which tensile strength thereof is 180 $N/mm^2$, yield strength thereof is 80 $N/mm^2$, and elongation thereof is 25%, and corrosion resistance thereof is also excellent. Therefore, the 3004 aluminum alloy is a suitable material for use as a heat shielding sheet. In addition, a 1000 series aluminum in which the purity of aluminum is high is preferable since it is easy to work. In particular, 1050 aluminum is preferable since it is generally commercially available.

The present invention also concerns a heat shielding cover including the metallic molded sheet 1 having a corrugated surface in which the first waveforms 2*a* and the second waveforms 2*b* perpendicularly intersect each other. Since the ridge lines of the first waveforms 2*a* and the ridge lines of the second waveforms 2*b* perpendicularly intersect each other, and the highest points T are arrayed in lattice form, the metallic molded sheet 1 can be easily curved and is excellent in workability. Moreover, since the metallic molded sheet 1 is free of bent portions such as those shown in FIGS. 7A and 7B, even if the metallic molded sheet 1 is subjected to vibration under heat, neither cracks nor fracture occur.

EXAMPLES

Hereafter, the invention will be further described by citing examples, but the invention is not limited to the same.

Example 1

A specimen with sides each measuring 250 mm was cut out from a 1050 aluminum alloy sheet with a sheet thickness of 0.4 mm, and was passed between the pair of first corrugating rolls having a wave height of 2.8 mm, an interval between crests (pitch) of 6.0 mm, and a gap between upper and lower rolls (D) of 1.5 mm. Then, the specimen having the first waveforms formed therein was passed between the pair of second corrugating rolls having the same teeth profile as the first corrugating rolls and a gap between upper and lower rolls (D) of 1.0 mm, in such a way that the ridge lines of the first waveforms perpendicularly intersected ridge lines of the teeth, to thereby allow the second waveforms to cross over the first waveforms and form the corrugated surface shown in FIG. 1.

Observations were made of a cross section (see A-A cross section in FIG. 2A), taken along a ridge line formed by the insertion between the first corrugating rolls, of the specimen with the corrugated surface formed therein and a cross section (see B-B cross section in FIG. 2B) taken along a ridge line formed by the insertion between the second corrugating rolls, and no bent portions were observed in both cross sections.

In addition, the following evaluations were made of the corrugated aluminum alloy sheet. The results are shown in Table 1.

Flexural Rigidity

A three-point bending test was conducted by a universal testing machine (sample size: 50 mm×100 mm) to determine the maximum strength (flexural strength).

Drawability

Drawing was carried out by a mold to measure the drawing depth. In addition, the presence or absence of the occurrence of cracks and pinholes at the time of working was confirmed.

Comparative Example 1

With respect to a 1050 aluminum alloy sheet with a thickness of 0.4 mm, evaluations were made of (1) flexural rigidity and (2) drawability mentioned above. The results are shown in Table 1.

Comparative Example 2

With respect to a 1050 aluminum alloy sheet with a thickness of 0.8 mm, evaluations were made of (1) flexural rigidity and (2) drawability mentioned above. The results are shown in Table 1.

Comparative Example 3

By using a 1050 aluminum alloy sheet with a thickness of 0.3 mm and a 1050 aluminum alloy sheet with a thickness of 0.125 mm, corrugation was provided in accordance with the method described in the patent document 2. The resultant aluminum alloy sheet exhibited a cross-sectional shape shown in FIGS. 7A and 7B. With respect to this corrugated aluminum alloy sheet, evaluations were made of (1) flexural rigidity and (2) drawability mentioned above. The results are shown in Table 1.

Comparative Example 4

By using a 1050 aluminum alloy sheet with a thickness of 0.4 mm, a multiplicity of semispherical protrusions of two kinds whose cross sections were 3.7 mm and 4.6 mm in radius were formed by draw forming by a press in accordance with the method described in the patent document 1. With respect to this draw-formed aluminum alloy sheet, evaluations were made of (1) flexural rigidity and (2) drawability mentioned above. The results are shown in Table 1.

Comparative Example 5

By using a 1050 aluminum alloy sheet with a thickness of 0.4 mm, a multiplicity of protrusions whose cross sections were trapezoidal (length of an opening, 8.0 mm; depth, 1.5 mm; and length of a bottom, 8.0 mm) were formed by draw forming by a press. With respect to this draw-formed aluminum alloy sheet, evaluations were made of (1) flexural rigidity and (2) drawability mentioned above. The results are shown in Table 1.

TABLE 1

| | | Example 1 | Comparative Example 1 | Comparative Example 2 | Comparative Example 3 | Comparative Example 4 | Comparative Example 5 |
|---|---|---|---|---|---|---|---|
| Remarks | | invention | flat sheet as it is | flat sheet as it is | patent document 2 | patent document 1 | |
| Forming method | | corrugation | none | none | corrugation | press drawing | press drawing |
| Sectional shape | | sinusoidal | rectilinear | rectilinear | See FIGS. 7A and 7B | semispherical | trapezoidal |
| Thickness (mm) | | 0.4 | 0.4 | 0.8 | 0.3 + 0.125 | 0.4 | 0.4 |
| Number of laminations | | 1 | 1 | 1 | 2 | 1 | 1 |
| Thickness after forming (mm) | | 1.8 | 0.4 | 0.8 | 4.5 | 1.8 | 1.8 |
| Weight (kg/m$^2$) | | 1.2 | 1.1 | 2.2 | 1.6 | 1.1 | 1.1 |
| Flexural rigidity | Flexural strength (N) | 42.0 | 8.8 | 35.0 | 56.1 | 41.5 | 40.0 |
| | Equivalent thickness (mm) | 0.8 | 0.4 | 0.8 | 1.0 | 0.9 | 0.9 |
| Drawability (track type) | Drawing depth (mm) | 35 | 25 | 35 | 40 | 20 | 20 |
| | Relative occurrence of cracks and pinholes | none | very small | none | large | large | large |

From Table 1, it can be appreciated that the corrugated aluminum alloy sheet of Example 1 in accordance with the invention excels in flexural rigidity and also excels in drawability.

The invention was detailed with reference specified embodiments. However, it is obvious to a person skilled in the art that the invention may be variously modified and corrected without deviating from the spirit of the invention.

This application is based on Japanese Patent Application No. 2008-029003 filed on Feb. 8, 2008 and an entirety thereof is incorporated herein by reference.

Furthermore, all references cited here are incorporated by reference.

The invention claimed is:

1. A process for producing a metallic molded sheet, said process comprising:

a step of providing a metallic sheet having a thickness of 0.2 to 0.5 mm;

a step of passing the metallic sheet between a pair of first corrugating gear rolls having on their respective surfaces teeth which are formed along an axial direction of the first corrugating gear rolls and are meshed with each other in the form of gears, to thereby obtain a metallic molded sheet having first waveforms;

a step of passing the metallic molded sheet having the first waveforms between a pair of second corrugating rolls having on their respective surfaces teeth which are formed along an axial direction of the second corrugating gear rolls and are meshed with each other in the form of gears, in such a way that ridge lines of the first waveforms and ridge lines of the teeth of the second corrugating gears rolls perpendicularly intersect each other; and defining a roll gap between bottom lands of one of the second corrugating gear rolls and top lands of the other of the second corrugating gear rolls that is wider than a roll gap between bottom lands of one of the first corrugating gear rolls and top lands of the other of the first corrugating gear rolls.

2. The process for producing a metallic molded sheet according to claim 1, wherein the roll gap between the second corrugating rolls is greater than 1 to 3-fold the roll gap between the first corrugating rolls.

3. The process for producing a metallic molded sheet according to claim 1, wherein an interval between crests of the first corrugating rolls and the second corrugating rolls is 3 to 9 mm.

4. The process for producing a metallic molded sheet according to claim 1, wherein the metal sheet is an aluminum sheet or a stainless steel sheet.

5. The process for producing a metallic molded sheet according to claim 1, wherein the metal sheet is a 3000 series aluminum alloy sheet or a 1000 series aluminum alloy sheet.

* * * * *